US006736535B2

(12) United States Patent
Halsall et al.

(10) Patent No.: US 6,736,535 B2
(45) Date of Patent: May 18, 2004

(54) METHOD FOR CONTINUOUS INTERNAL AGITATION OF FLUID WITHIN HOT WATER HEATERS OR OTHER FLUID CONTAINING VESSELS

(76) Inventors: Richard W. Halsall, 6370 Forest Grove Dr., Georgetown, IN (US) 47122; Robert M. Miller, 7103 Anglers Cove, Georgetown, IN (US) 47122

( * ) Notice: Subject to any disclaimer, the term of this patent is extended or adjusted under 35 U.S.C. 154(b) by 0 days.

(21) Appl. No.: 10/158,855

(22) Filed: Jun. 3, 2002

(65) Prior Publication Data

US 2003/0223305 A1 Dec. 4, 2003

(51) Int. Cl.[7] ..... B01F 11/02

(52) U.S. Cl. ..... 366/116; 366/118; 366/127; 366/144; 366/146; 122/19.1; 122/380

(58) Field of Search ..... 366/108, 114–116, 366/118, 127, 144, 146, 348, 601; 134/184; 122/13.01, 19.1, 379, 380

(56) References Cited

U.S. PATENT DOCUMENTS 3,318,578 A * 5/1967 Branson ..... 366/118
3,433,461 A * 3/1969 Scrapa ..... 366/112
3,550,657 A * 12/1970 Swanke ..... 241/199.1
3,720,402 A * 3/1973 Commins et al. ..... 366/114
3,851,861 A * 12/1974 Cummins et al. ..... 366/114
3,985,344 A * 10/1976 McCord ..... 366/127
4,107,790 A * 8/1978 McCord ..... 366/127
4,930,532 A * 6/1990 Mayer ..... 134/184
5,037,208 A * 8/1991 Dussault et al. ..... 366/127
5,276,376 A * 1/1994 Puskas ..... 310/317
5,736,100 A * 4/1998 Miyake et al. ..... 422/64

FOREIGN PATENT DOCUMENTS

GB 2338972 A * 1/2000

* cited by examiner

*Primary Examiner*—Charles E. Cooley
*Assistant Examiner*—David Sorkin
(74) *Attorney, Agent, or Firm*—Bradford E. Kile

(57) ABSTRACT

The act of heating water within a contained vessel that is common to most buildings, whether residential or commercial or located in recreational vehicles, mobile homes, aircraft, ships or marine pleasure craft, causes calcium carbonate to precipitate out and settle to the bottom of a heating or fluid containing vessel. The use of ultrasonic transmission within the vessel will agitate the water held within, preventing the normally stagnant hot water from producing calcium carbonate. Other benefits are the cleaning properties of ultrasonic transmission. Thus the internal parts of hot water heaters will enjoy a longer life. This benefit of agitation will also be found when applied to vessels that contain fluids that share similar problems as hot water heaters.

4 Claims, 4 Drawing Sheets

METHOD FOR CONTINUOUS INTERNAL AGITATION OF FLUID WITHIN HOT WATER HEATERS OR OTHER FLUID CONTAINING VESSELS

BACKGROUND OF THE INVENTION

Field of the Invention

The present invention relates to a method for continuous internal agitation of fluid within fluid containing vessels. More specifically, the invention is directed at providing a method for decreasing the build-up of sediment common in fluid containing vessels due to the heating of the fluid, and, thus, maintaining the most efficient operation of the vessel and increasing the duration of the vessel's purpose.

In the past, there have been problems of premature hot water heater failure and reduced energy efficiency of the heater due to calcium sediment build-up. Water heater sediment is a common problem contributing to inefficiency and shortened longevity of water heaters. Both natural gas ("gas-fired") and electric water heaters are plagued from problems caused directly by calcium build-up. More specifically, heating water causes calcium carbonate to precipitate out and settle to the bottom of a water heater. Sediment build-up can reduce the holding capacity of a hot water heater or other fluid containing vessel, and can get into the circulating lines as well as causing problems with the check valves and circulating pump.

Within a gas-fired heater the build-up of a sediment layer inside the tank prevents the rapid transfer of heat to the water from the gas flame. Another problem with a gas-fired heater caused by sediment build-up is the production of gas bubbles forming under a layer of sediment, causing thumping and popping noises as the gas bubbles escape from under the sediment layer.

Electric water heaters are also subject to sediment build-up in the bottom of the fluid containing vessel, but they do not suffer from the problems of noise that is found within gas-fired water heaters. However, electric heaters' accumulation of calcium build-up reduces the heat transfer rate, lowering the efficiency of the heater. Eventually the calcium build-up on the heating elements will cause a failure due to localized overheating of the element.

Hot water heater manufacturers recommend draining a few quarts of water from the tank every month to aid in preventing the build-up of calcium sediment in the tank. However, following such prevention procedures neither ensures that calcium build-up will not be problematic to the functioning and efficiency of the hot water heater, nor does it eliminate the source of the calcium sediment build-up, stagnate water producing calcium carbonate. Previous attempts for preventing the build-up of sediment were in the form of a cold-water delivery tube that would agitate the incoming cold water through openings cut into the length of the tube.

Accordingly, it would be desirable to provide method for continuous internal agitation of fluid within hot water heaters and other fluid containing vessels susceptible to calcium sediment build-up that is capable of significantly reducing or eliminating the build-up of calcium sediment. It would be further desirable to provide a method which is systematically regular, if not constant, in preventing any sediment from collecting in the hot water heater tank or other fluid containing vessel.

Additionally, ultrasonic agitation would provide a method which is systematically regular, or constant, in preventing sediment build-up and is a proven technology and has enjoyed successful use in many industries. Contaminants are either dissolved or displaced by the mechanical process of ultrasonic agitation. Ultrasonic agitation results in a dual benefit when used in electric hot water heaters, preventing sediment build-up and cleaning the electrical heating elements within a hot water heater. Ultrasonic transmission causes a phenomenon known as cavitation. Cavitation is the rapid formation and collapse of vapor pockets in an ultrasonic activated liquid in regions of very low pressure. Cavitation "bubbles" and ultrasonic micro-agitation work to dissolve soluble contaminants and displace insoluble particles. This occurs without causing damage to the surfaces in contact with the water within the tank.

The difficulties, limitations and desires suggested in the preceding are not intended to be exhaustive, but rather are among many which demonstrate that prior art systems and methods for internal agitation of fluid containing vessels will admit to worthwhile improvement.

OBJECTS OF THE INVENTION

It is, therefore, a general object of the invention to provide an efficient method of maintaining a clean internal environment to any hot water heater or a vessel containing a fluid that is prone to contamination.

It is another general object of the invention to provide a method that will prolong the useful life of a hot water heater or fluid-containing vessel.

It is another general object of the invention to provide a method that will prevent the build-up of sediment in a hot water heater tank and prevent the sediment from entering the circulation lines, circulation pump and check valves.

SUMMARY OF THE INVENTION

To achieve at least some of the foregoing objects, the subject invention provides a method for continuous internal agitation of hot water heaters and other fluid containing vessels. The present invention consists of ultrasonic transmitting and cycle timing circuit equipment adapted to the liquid filled vessel. In the case of a hot water heater, which is the typical embodiment, the ultrasonic transducer is to be immersed into the tank. For application when the present invention is not a part of a newly manufactured heater or fluid vessel the embodiment will demonstrate methods that will affix the ultrasonic device to a typical hot water heater tank.

Further, the invention is capable of being applied in all fluid containing vessels that will benefit from ultrasonic agitation. The subject invention can find application within the liquid cooling system of an internal combustion engine, which is most commonly found in automobile or truck engines. The subject invention can be applied to a liquid cooling system, which is a fluid-containing closed system, comprising a radiator, an engine water jacket, a liquid reservoir or overflow tank, a water pump, hoses, and a heater core. Sediment build-up in liquid cooling systems of internal combustion engines can result in higher engine temperatures, which can lead to overheating and engine failure. When the subject invention is applied to a liquid cooling system of an internal combustion engine it will be able to provide a clean internal environment, allowing optimum performance of the cooling system and preventing overheating and engine failure.

Preventing sediment build-up allows the fluid containing vessel to be more efficient and prevents damage to the vessel and related components, such as circulating lines, pumps, and valves. The mechanical vibrations caused by the transducer prevent sediment from forming and building-up in the vessel. The duration of a fluid containing vessel can be extended, and common problems of sediment entering other fluid circulating pipes, hoses and devices is significantly reduced.

DRAWINGS

Other objects and advantages of the present invention will become apparent from the following detailed description of preferred embodiments thereof taken in conjunction with the accompanying drawings, wherein:

FIG. 1*a* is block diagram of the method for a typical installation of ultrasonic device to a hot water heater.

FIG. 1*b* is a block diagram of an ultrasonic generator and timing circuit.

DETAILED DESCRIPTION

Figure 1A:
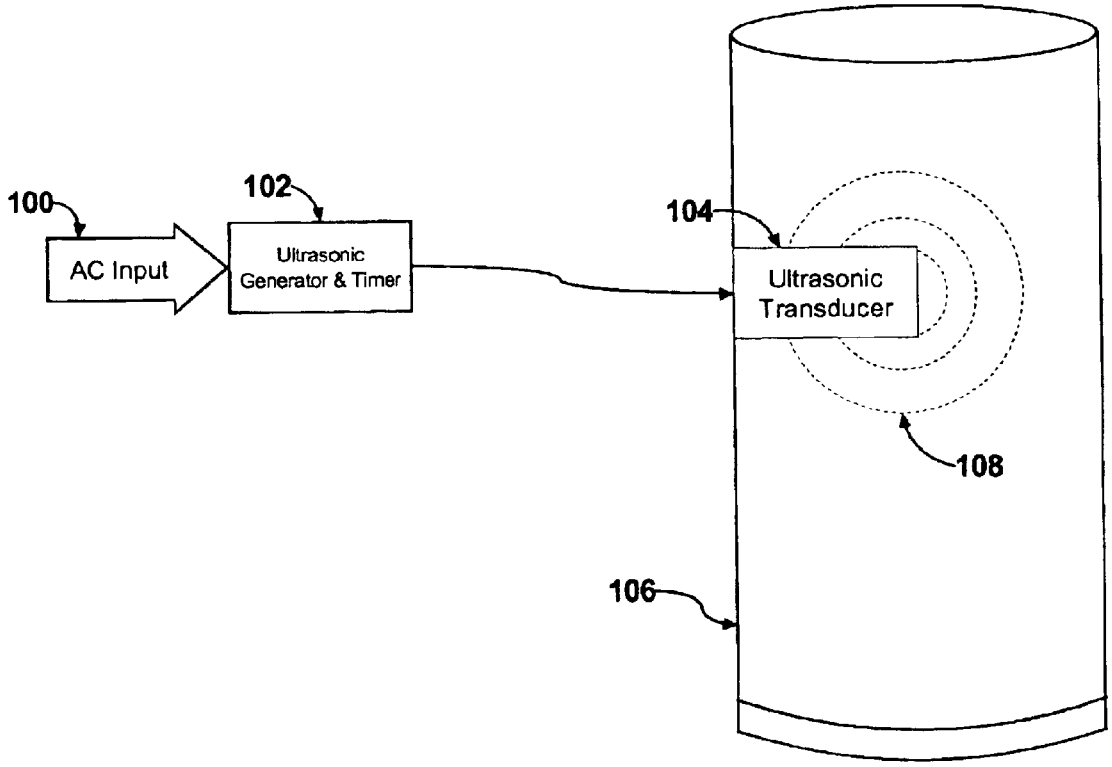

The present invention is a method for continuous internal agitation of hot water heaters and other fluid containing vessels. Referring to FIG. 1*a*, a block diagram of the method for a typical installation of ultrasonic device to a hot water heater, normal alternating current ("AC") 100 is directed to the ultrasonic generator and timer 102. The ultrasonic generator and timer 102, converts electrical energy from the incoming power line 100, at 50 Hz or 60 Hz to electrical energy at the desired ultrasonic frequency. Such generators 102, currently manufactured, have features such as square wave outputs, or pulsing of the output of energy on and off, also frequency modulating techniques of the output frequency around the central operating frequency. Any of the generators mentioned above can be suited for the present invention. The hot water heater 106, is either a gas-fired or electric type heater. Inside the hot water heater 106, is the ultrasonic transducer 104. Two types of ultrasonic transducers are used in ultrasonic agitation. The transducer 104 can be either Magnetostrictive (See FIG. 2), or Piezoelectric (See FIG. 3). The ultrasonic transducer 104, in either embodiment, converts the electrical energy from the ultrasonic generator into mechanical vibrations 108.

Figure 1B:
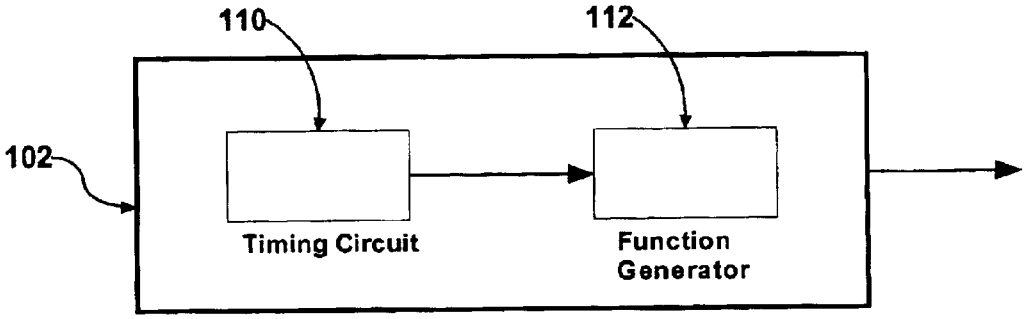

Referring to FIG. 1*b*, a block diagram of an ultrasonic generator and timing circuit 102, the purpose of the timing circuit 110 is to allow a user or manufacturer to cycle the output of the ultrasonic frequency or frequencies. This timing feature can also be automated depending on the need of the user. The ultrasonic generator is a function generator 112 that produces an output frequency of an ultrasonic value, which is typically 18 to 120 kHz.

Figure 2:
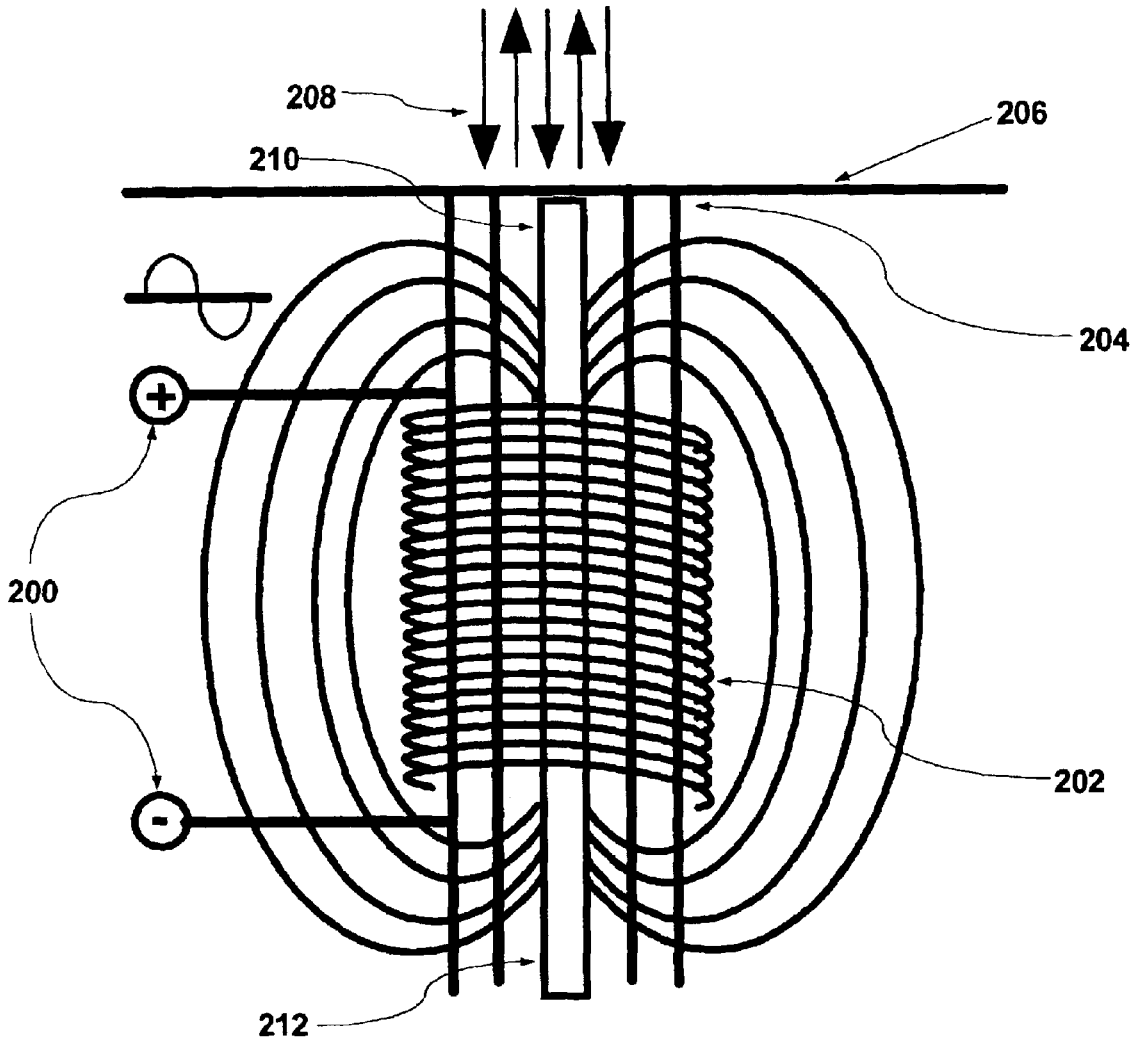
FIG. 2 illustrates a view of the working principles of a Magnetostrictive Transducer.

Referring to FIG. 2, a general view of a Magnetostrictive type of ultrasonic transducer is shown. Alternating electrical energy from the ultrasonic generator 200 (See FIG. 1, 102), is first converted into an alternating magnetic field through the use of a coil wire 202. The magnetic field has a north pole 210 and a south pole 212. The alternating electrical field is used to induce mechanical vibrations at the ultrasonic frequency in resonant strips 204, of nickel or magnetostrictive material, that material is attached to the surface to be vibrated 206. Due to the behavior of the magnetostrictive material the frequency of the electrical energy applied to the transducer is half the desired output frequency 208. The use of a magnetostrictive transducer is possible for the invention, however, certain restrictions in frequency, and low efficiency point to a better type transducer, the Piezoelectric Transducer (See FIG. 3).

Figure 3:
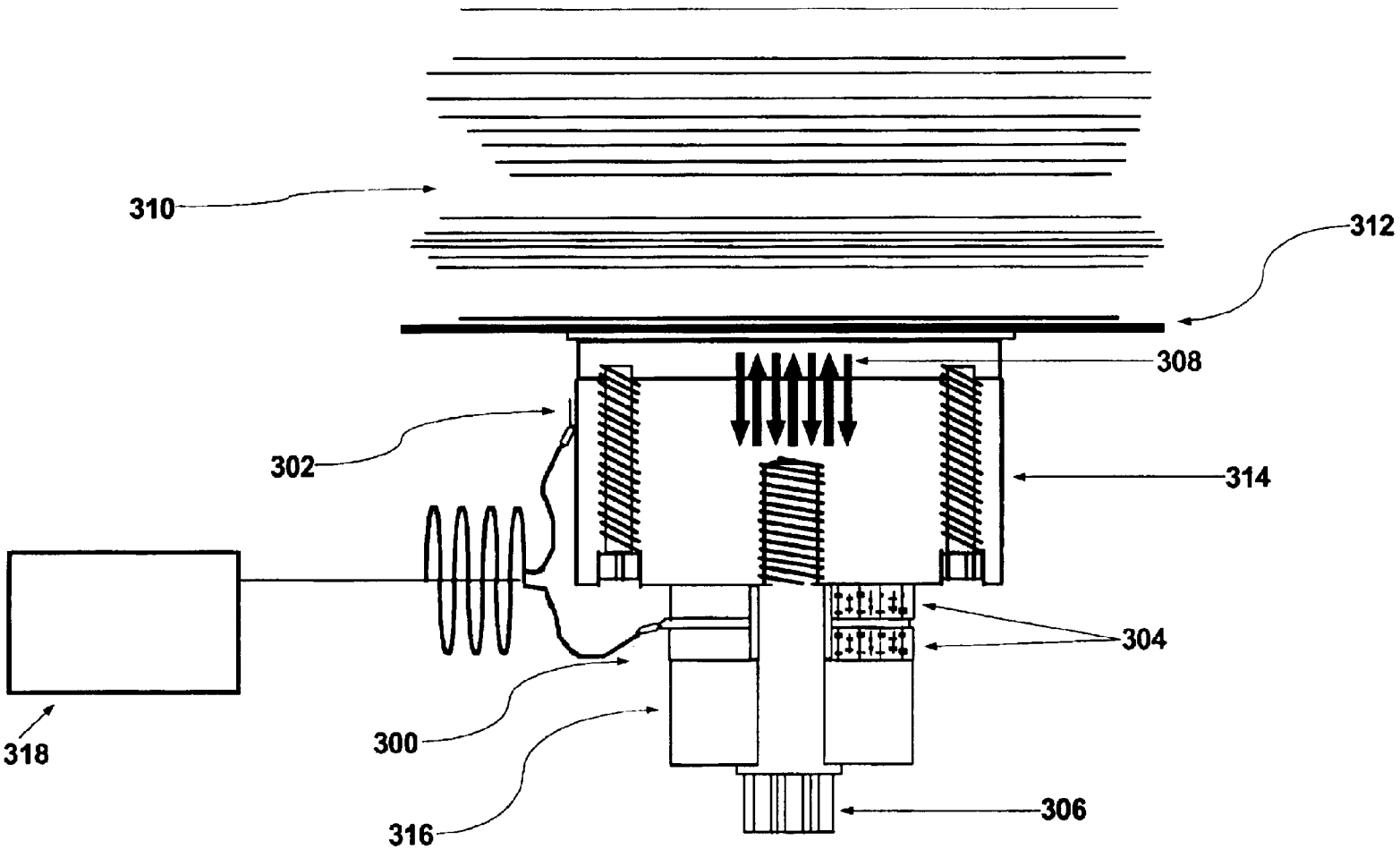
FIG. 3 illustrates a view of a Piezoelectric Transducer.

Referring to FIG. 3, a cutaway view of the typical piezoelectric type transducer is shown. Electrical energy at the ultrasonic frequency is transferred from the ultrasonic generator and timer 318 to a piezoelectric transducer via electrode 300. A ground connection 302 is made to the outside of the transducer. The piezoelectric elements 304 of the transducer vibrate. Amplifications of the vibrations due to the piezoelectric elements 304 is accomplished by the resident masses, front mass 314 and back mass 316, attached by bolt 306 of the transducer. The vibration 308 is directed to fluid 310 by way of a radiating plate 312. The piezoelectric type transducer is the preferred method for use in the envisioned invention.

Figure 4:
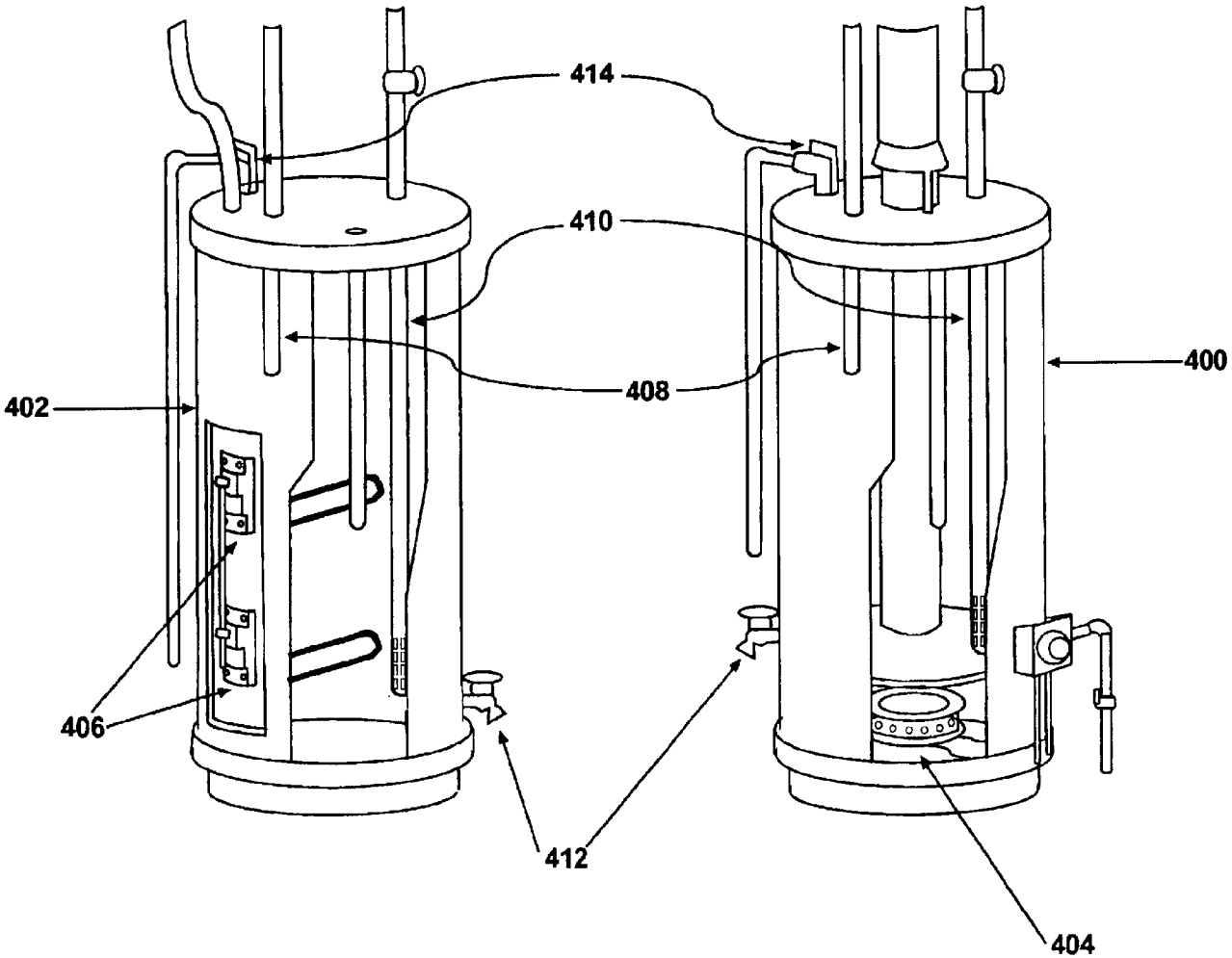
FIG. 4 is a cutaway view of generic electric and gas-fired hot water heaters with a block diagram of the ultrasonic device and its connect points.

FIG. 4 is a cutaway view of two types of typical hot water heaters, gas-fired 400 and electrical 402. The internal tanks of the two types of hot water heaters are filled with water and then heated to a preset temperature by either a gas flame 404, or electrical elements 406, respectively. The heated water is drawn from the tank by demand of a user through a hot water pipe 408. The heated water that is drawn is replaced by cold water though the cold water feed pipe 410.

For hot water heaters that are not manufactured with the present invention, modification of existing tanks can be easily made. The placement of a transducer on hot water heaters that are in use can be made via existing openings on the tank. The existing openings on the gas-fired hot water heater are a drain valve 412 and a temperature and pressure relief valve 414. Other openings on the electrical hot water heater are on the upper or lower heating elements 406. The manufacture of the replacement part would include the present invention's transducer. The preferred location is the drain valve 412, however, each of the aforementioned locations can support the introduction of a transducer. For newly manufactured hot water heaters, the manufacturer can select the location of the transducer.

Summary of Major Advantages of the Invention

After reading and understanding the foregoing description of preferred embodiments of the invention, in conjunction with the illustrative drawings, it will be appreciated that several distinct advantages of the subject method for continuous internal agitation of hot water heaters and other fluid containing vessels.

One advantage of the present invention is that it provides improvements in fluid heating efficiency.

Another advantage of the present invention is that it reduces and prevents the accumulation of sediment in hot water heaters and other fluid containing vessels.

Yet another advantage of the present invention is that it allows improved efficiency in existing hot water heaters.

A further advantage of the present invention is that it allows installation of a transducer to existing openings in hot water heaters instead of requiring a new hot water heater or other fluid containing vessel to be purchased with the present invention incorporated into the design.

In accordance with the foregoing, the present invention provides a method for continuous internal agitation of hot water heaters and other fluid containing vessels. The present invention allows a method that increases efficiency, prevents contamination and increases the longevity of hot water heaters and other fluid containing vessels.

An ultrasonic transducer is a machine that converts electrical energy received from an ultrasonic generator into mechanical vibrations. More specifically, an ultrasonic transducer is an electroacoustical device, usually piezoelectric or magnetostrictive, that converts ultrasonic waves into electromagnetic waves, or electromagnetic waves into ultrasonic waves. These mechanical vibrations at the right frequency keep fluids, such as water, from being contaminated and, thus, prevent the sedimentary build-up of such contaminants.

Magnetostrictive materials transduce or convert magnetic energy to mechanical energy and vice versa. As a magnetostrictive material is magnetized, it strains; that is it exhibits a change in length per unit length. Conversely, if an external force produces a strain in a magnetostrictive material, the material's magnetic state will change. This bi-directional coupling between the magnetic and mechanical states of a magnetostrictive material provides a transduction capability that is used for both actuation and sensing devices. Magnetostriction is an inherent material property that will not degrade with time.

An ultrasonic generator is an electroacoustical device that generates frequencies at or above 20 kilohertz (KHz). In the present invention the ultrasonic generator produces frequencies that are sent along to the ultrasonic transducer, where they are converted into mechanical vibrations.

In describing the invention, reference has been made to preferred embodiments and illustrative advantages of the invention. Those skilled in the art, however, and familiar with the instant disclosure of the subject invention, may recognize additions, deletions, modifications, substitutions and other changes that fall within the purview of the subject invention.

What is claimed:

1. A method for internal agitation of water within a hot water heater for preventing calcium carried by water within said hot water heater from creating calcium deposits within said hot water heater, said method comprising the steps of:

affixing a timer and an ultrasonic generator to said hot water heater;

directing an electrical current to said timer and ultrasonic generator;

converting said electrical current into an electrical current at a desired ultrasonic frequency;

converting said electrical current at a desired ultrasonic frequency into mechanical vibrations by, applying ultrasoinic frequency electrical pulses to a piezoelectric transducer; and applying said ultrasonic mechanical vibrations to water within said hot water heater by, positioning said piezoelectric transducer within said hot water heater at a position to operably contact water within said hot water heater for preventing calcium from building-up and creating calcium deposits within said hot water heater.

2. A method for internal agitation of a water within a hot water heater as defined in claim 1 wherein:

said step of directing an electrical current is intermittent as controlled by said timer.

3. A method for internal agitation of water within a hot water heater for preventing calcium carded by water within said hot water heater from creating calcium deposits within said hot water heater, said method comprising the steps of:

affixing a timer and an ultrasonic generator to said hot water heater;

directing an electrical current to said timer and ultrasonic generator;

converting said electrical current into an electrical current at a desired ultrasonic frequency;

converting said electrical current at a desired ultrasonic frequency into mechanical vibrations by, applying ultrasonic frequency electrical pulses to a magnetostrictive transducer; and applying said ultrasonic mechanical vibrations to water within said hot water heater by, positioning said magnetostrictive transducer within said hot water heater at a position to operably contact water within said hot water heater for preventing calcium from building-up and creating calcium deposits within said hot water heater.

4. A method for continuous internal agitation of a fluid within a vessel as defined in claim 3 wherein:

said step of directing an electrical current is intermittent as controlled by said timer.

* * * * *